US012551944B2

(12) United States Patent
Garcia-Bragado et al.

(10) Patent No.: US 12,551,944 B2
(45) Date of Patent: Feb. 17, 2026

(54) ACTUATOR FOR A CASTING MOLD FOR PRODUCING METAL COMPONENTS

(71) Applicant: voestalpine Additive Manufacturing Center GmbH, Düsseldorf (DE)

(72) Inventors: Federico Garcia-Bragado, Düsseldorf (DE); Ernst Neunteufl, Branau (AT); Simon Frank, Neuhofen im Innkreis (AT); Stefan Gneiger, Weistrach (AT)

(73) Assignee: VOESTALPINE STAHL GMBH, Linz (AT)

( * ) Notice: Subject to any disclaimer, the term of this patent is extended or adjusted under 35 U.S.C. 154(b) by 0 days.

(21) Appl. No.: 18/010,859

(22) PCT Filed: Jun. 15, 2021

(86) PCT No.: PCT/EP2021/066108

§ 371 (c)(1),
(2) Date: Dec. 16, 2022

(87) PCT Pub. No.: WO2021/255023

PCT Pub. Date: Dec. 23, 2021

(65) Prior Publication Data

US 2023/0234126 A1 Jul. 27, 2023

(30) Foreign Application Priority Data

Jun. 18, 2020 (DE) ..... 10 2020 116 143.3

(51) Int. Cl.
*B22D 27/02* (2006.01)
*B22D 15/00* (2006.01)

(52) U.S. Cl.
CPC ..... *B22D 27/02* (2013.01); *B22D 15/00* (2013.01)

(58) Field of Classification Search
CPC ..... B22D 27/02
See application file for complete search history.

(56) References Cited

U.S. PATENT DOCUMENTS 3,911,997 A * 10/1975 Sugazawa ..... B22D 11/122 505/914
2012/0042993 A1* 2/2012 Ripley ..... C22F 1/00 164/498
2020/0338635 A1* 10/2020 Takahashi ..... B22C 9/06
(Continued)

FOREIGN PATENT DOCUMENTS

CN 102179505 A 9/2011
CN 103658609 A 3/2014
CN 104439203 A * 3/2015 ..... B22D 27/02
(Continued)

OTHER PUBLICATIONS

Machine Translation of Zhai et al (CN 103658609A, published Mar. 26, 2014, cited in IDS filed Mar. 9, 2023). (Year: 2014).*
(Continued)

*Primary Examiner* — Keith Walker
*Assistant Examiner* — Jacky Yuen
(74) *Attorney, Agent, or Firm* — STAAS & HALSEY LLP

(57) ABSTRACT

An actuator for a casting mold for producing a metal component has at least two electrodes in contact with the metal melt for generating a local, pulsing electric field in a metal melt present in the casting mold and for introducing a pulsing current into the metal melt.

17 Claims, 6 Drawing Sheets

(56) References Cited

U.S. PATENT DOCUMENTS

2021/0237150 A1* 8/2021 Rihtaric ..... B22D 18/08

FOREIGN PATENT DOCUMENTS

| | | | | |
|---|---|---|---|---|
| DE | 10 2005 009 326 | A1 | 9/2006 | |
| EP | 1502677 | A1 * | 2/2005 | ..... B22D 11/115 |
| JP | S49-30613 | B1 * | 8/1974 | |
| JP | 64-31939 | | 2/1989 | |
| WO | WO 2019/204845 | A1 | 10/2019 | |

OTHER PUBLICATIONS

Machine Translation of Wang (CN 102179505 A, published Sep. 14, 2011, cited in IDS filed Mar. 9, 2023). (Year: 2011).*

Japanese Office Action issued in counterpart Japanese Application No. 2022-575326 dated Jan. 9, 2024.

Yunhu Zhang et al. "Comparative Study on the Grain Refinement of Al—Si Alloy Solidified under the Impact of Pulsed Electric Current and Travelling Magnetic Field", MDPI, Metals, Jul. 20, 2016.

Y.H. Zhang et al. "Relevance of electrical current distribution to the forced flow and grain refinement in solidified Al—Si hypoeutectic alloy", www.nature.com/Scientific Reports, Feb. 19, 2018.

English Translation of IPRP (PCT/IB/373) (Dec. 13, 2022) and the Written Opinion of ISA (PCT/ISA/237) based on International Search Report, issued in counterpart International Application No. PCT/JP2021/066108 on Jul. 30, 2021 (8 pages).

Canadian Office Action issued in counterpart Canadian Application No. 3,186,984 dated Apr. 12, 2024.

First Chinese Office Action dated Jan. 1, 2026 for parallel Chinse Application No. 202180043162.1.

* cited by examiner

ACTUATOR FOR A CASTING MOLD FOR PRODUCING METAL COMPONENTS

CROSS-REFERENCE TO RELATED APPLICATIONS

This application is a U.S. national stage of International Application No. PCT/EP2021/066108, filed on Jun. 15, 2021, which International Application claims the priority benefit of German Patent Application No. 10 2020 116 143.3, filed on Jun. 18, 2020. Both International Application No. PCT/EP2021/066108 and German Patent Application No. 10 2020 116 143.3 are incorporated by reference herein in their entirety.

BACKGROUND

An aspect of the invention relates to an actuator for a casting mold for producing a metal component, and to an apparatus and a method for producing a metal component.

To improve the mechanical properties of cast components, measures are applied which cause grain refinement in the solidifying metal melt.

One known possibility is to increase the cooling rate of the metal melt during solidification. This means that less time is available for grain growth. In thick-walled components in particular, however, it is not always possible to achieve sufficiently rapid cooling, or it is very complex in terms of mold technology.

Another possibility is to add grain-refining agents (e.g. TiB particles) to the metal melt. These act as crystallization nuclei, increase the number of grains and thus limit grain growth. Disadvantages are the high costs and the comparatively low efficiency (only about 15% grain size reduction). In addition, the mechanical properties of a component cannot be influenced locally, but only over the entire component.

SUMMARY

An underlying problem can be seen in providing a cost-effective and versatile concept for achieving improved mechanical properties of cast components.

The problem underlying the described examples may be solved by the features of the independent claims. Further developments and examples may be the subject of the dependent claims.

Accordingly, an actuator for a casting mold for producing a metal component can have at least two electrodes in contact with the metal melt, which serve to generate a local, pulsing electric field in a metal melt present in the casting mold and to introduce a pulsing current into the metal melt.

It has been shown that by coupling a pulsing electric field and introducing a pulsing current into the metal melt, it is possible to reduce grain growth during the solidification process and thus effectively limit the average grain size. Suitable positioning of the actuator on or in the casting mold can bring about a targeted, local increase in the mechanical properties of the component. Due to the simplified design of the actuator and its local application, the concept described here can be used for a wide range of mold and component engineering tasks.

The grain-refining effect of a high pulsing electric field (i.e., a pulsing current in the metal melt) on grain growth is probably due to the difference in electrical conductivity between dendrites and the surrounding metal melt, which leads to high heat generation at tips of the dendrites and thus to melting of the dendrite tips that slows grain growth. The melting delays the constitutional supercooling of the metal melt, which causes dendritic growth.

The formation and growth of a dendrite is defined by the solidification-induced concentration gradient in the vicinity of its phase interface, as well as the temperature regime. This dependence is described by the concept of constitutional supercooling. In the approach followed here, a weak discontinuous local flow is used to achieve a concentration and temperature equilibrium in the vicinity of the dendrite. This reduces the constitutional supercooling and the growth of the dendrite is hindered or slowed down. In other words, heterogeneous nucleation is suppressed in favor of homogeneous nucleation, which results in grain refinement in the later cast component. The most isotropic properties possible of the cast component can be achieved.

According to an example, the actuator further comprises a magnetic field coil for generating a local magnetic field in the metal melt, wherein in operation of the actuator the magnetic field coil is arranged between the at least two electrodes. By superimposing a static magnetic field or an alternating magnetic field on the pulsing electric field, the grain growth can be further influenced.

In particular, it is possible in this way to generate a targeted movement of the metal melt which causes increased mixing of the metal melt at least in the area near the edge of the casting mold. This reduces the concentration and temperature differences present there, slows grain growth and creates time for increased endogenous nucleation. The deflection of the metal melt can be very small and manifest itself in an oscillation, whereby the metal melt does not move in total.

In other words, with the (optional) use of a magnetic field coil, the magnetic field generated by the current flow in the metal melt itself can interact with the externally applied magnetic field generated by the magnetic field coil, thereby generating a repulsion that forms a field-dependent flow in the metal melt.

The superposition of the pulsing electric field with a static magnetic field or an alternating magnetic field makes it possible to achieve the desired grain refinement even at lower electric fields (current strengths) than in the case without a magnetic field, which facilitates compliance with electromagnetic compatibility.

For example, during operation of the actuator, the at least two electrodes and the magnetic field coil may be arranged such that the magnetic field is substantially perpendicular to the electric field. This allows different effects to be achieved in the metal melt through interaction of the fields and depending on the control of the electrodes and the magnetic field coil by electromagnetic induction, which will be explained in more detail below.

The actuator can have a housing accommodating the magnetic field coil, which is configured for installation in a wall recess of the casting mold. This allows the housing (which may optionally also contain the at least two electrodes) to be fixedly anchored in or to the casting mold. For example, the housing can have a cylindrical shape, whereby the wall recess of the casting mold can be designed as a simple bore into which the housing is inserted.

Furthermore, the housing can accommodate a cooling system that uses a coolant. In this way, undesirable heating of surrounding wall areas of the casting mold can be counteracted, especially at high magnetic field strengths.

An apparatus for producing a metal component can include a casting mold having a cavity for cast molding of the metal component and an actuator of the type described inserted into the casting mold. The actuator inserted in the casting mold can be used to improve the mechanical properties of specific areas of the metal component.

Such a closed casting mold with a cavity for cast molding of the metal component can have at least two mold halves, between which the cavity is formed, from which the metal component is removed after opening the casting mold halves. Due to the (closed) cavity, pressure can also be exerted on the melt in the casting mold, if necessary.

The casting mold and the actuator can be of modular design, i.e. the actuator can be combined with a variety of different casting molds. It is also possible, of course, to use several actuators intended for specific zones of the component. For a wide variety of component shapes and casting mold concepts, it is thus possible to easily create cast components with mechanical properties that are locally different and adapted to the intended use of the component.

For example, the cavity of the casting mold can define a component thickness and a surface shaping of the component, with the actuator being arranged adjacent to a local component thickening. Component thickenings, i.e. component areas with locally thicker walls, are required, for example, for connection zones (e.g. screw or plug-in couplings, flanges, etc.) of the components. In such areas, the cast component cools more slowly, so that it is precisely here that the grains are larger and reduced mechanical properties can occur. The described examples provide a remedy here.

The casting mold may have at least two holes for the at least two electrodes. Thus, each electrode can be accommodated in a bore of the casting mold, allowing direct electrical contact of the electrodes with the metal melt.

The casting mold can further have at least one central recess, for example a bore for a housing of a magnetic field coil of the actuator, with the at least two electrodes of the actuator being arranged on both sides of the central recess. This enables the magnetic field to be superimposed on the electric field generated by the electrodes in a structurally simple manner.

The described examples can be used in a wide variety of casting molds, including high pressure die casting molds, low pressure die casting molds, or gravity die casting molds (also known as permanent die casting molds). Since the actuator can be anchored in the casting mold in a pressure-resistant manner, the described examples may also be particularly well suited for high-pressure die casting, especially for aluminum die casting (high-pressure die casting). Conventional actuators, which are based on direct mechanical excitation or have a diaphragm for transmitting vibrations, are only suitable for high-pressure die casting to a limited extent due to the high working pressures and high wear.

According to an example of the method of producing a metal component, a casting mold may be filled with a metal melt. A local, pulsing electric field is generated in a metal melt present in the casting mold by at least two electrodes in contact with the metal melt to introduce a pulsing current into the metal melt.

By way of the electric field, for example, a power of 30 W (or possibly also 50 W) to 5 kW, for example, 30 W to 1 kW, in particular in an example 30 W to 200 W can be coupled into the metal melt and/or pulsing electric fields of a pulse frequency between 1 and 2500 Hz, for example between 40 Hz and 2000 Hz, in particular in an example between 40 Hz and 500 Hz can be used. Higher frequencies, e.g. up to 5000 Hz or above, are also possible and may also be helpful in achieving the effect according to the examples (grain refinement), but require more equipment and higher costs. In addition, cavitation (i.e. the formation of voids and jets) occurs in the melt in the range above 20 kHz, which leads to better mixing but also to degassing of the melt and is therefore may not useful in a closed mold, since the resulting gas bubbles/cavity bubbles cannot escape and would consequently lead to voids and increased porosity in the cast component.

A current amplitude of the pulses can, for example, be between 2 and 1000 A, for example between 50 and 800 A, in particular in an example between 90 and 500 A, or even higher. However, especially when using a magnetic field superimposing the current flow, even smaller current amplitudes of maximum 800 A, 600 A, 400 A, 200 A or 100 A can be sufficient for achieving effective grain refinement. Desired area current densities may result from the cross-sectional dimensions of the electrodes, which can range, for example, from a few square millimeters (e.g., 10 $mm^2$) to more than 100 or 200 $mm^2$. The voltage amplitude can be, for example, between 1 and 10 V and is mainly determined by contact resistances between the electrodes and the metal melt.

The examples of the method further comprise generating a local magnetic field in the metal melt, wherein the local, pulsing electric field and the local magnetic field are superimposed.

In this context, the magnetic field can, for example, couple a power of 10 W to 10 kW, for example 10 W to 1 kW, in particular in an example 20 W to 500 W, into the metal melt and/or the magnetic field can, for example, have an AC frequency between 5 and 25000 Hz, for example between 30 and 3000 Hz, in particular in an example between 30 and 80 Hz.

For the specific application of the method, the local, pulsing electric field and, if necessary, the local magnetic field can be generated in the region of a local wall thickening of the metal component.

BRIEF DESCRIPTION OF THE DRAWINGS

In the following, examples and further developments are explained in an exemplary manner on the basis of the drawings, whereby in some cases a different degree of detail is used in the drawings. Individual features of different examples and variants thereof can be combined with each other, provided this is not ruled out for technical reasons. Identical reference signs designate the same or similar parts.

DETAILED DESCRIPTION

Figure 1:
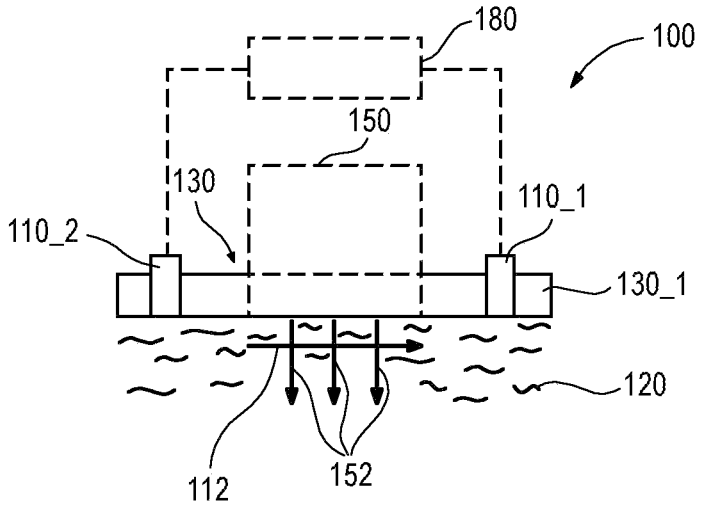
FIG. 1 shows an example of an actuator with multiple electrodes and an optional magnetic field coil for a casting mold.

FIG. 1 shows an example of an actuator 100 for a casting mold for producing a metal component. The actuator 100 has at least a first electrode 110_1 and a second electrode 110_2. The two electrodes 110_1 and 110_2 can be electrically controlled to generate a pulsing electric field in a metal melt 120. For this purpose, the two electrodes 110_1, 110_2 can, for example, protrude through a wall 130_1 of a casting mold 130 not shown in more detail in FIG. 1, so that they can be in direct electrical contact with the metal melt 120.

The two electrodes 110_1, 110_2 can, for example, be designed as electrically conductive contact pins which protrude (not shown) slightly (e.g., one or more mm) from the wall 130_1 in order to ensure reliable electrical contact with the metal melt 120—even during solidification of the metal melt 120 (shrinkage phase). That is, externally generated electrical signal pulses (current pulses) can be introduced directly into the metal melt 120 or passed through it via the electrodes 110_1, 110_2 that are in contact with the metal melt 120.

By way of protruding electrically conductive contact pins, it is possible to maintain direct electrical contact with the metal melt up to about 90% solid phase content in the melt.

The diameter of the contact pins can be selected so that a suitably high area current density is achieved for a given current. For example, a diameter of the pins can be in the range of 3 mm to 12 mm, in particular 6 to 8 mm, and a surface current density in the range of, for example, 1 to 10 $A/mm^2$, in particular 2 to 4 $A/mm^2$ can be generated (for example, for a current of about 100 A).

The metal melt 120 may be, for example, molten aluminum, molten zinc, molten magnesium, or molten brass, or may include aluminum-based alloys, zinc-based alloys, magnesium-based alloys, or copper-based alloys. Other metals, such as bronze, tin, chromium, nickel, or other materials may also be present in the metal melt 120 as base metals or alloying additions.

By applying a pulsing electric voltage to the two electrodes 110_1, 110_2, a pulsing electric field and thereby a pulsing electric current is generated in the metal melt 120. This external current is introduced directly into the metal melt 120 via the two electrodes 110_1, 110_2 (i.e., this is not an eddy current induced in the metal melt by, for example, alternating magnetic fields). This externally introduced electric current flows in the direction of the electric field, i.e., from one electrode 110_1 to the other electrode 110_2. The electric field thus has a main component 112 which extends substantially parallel to the wall 130_1 of the casting mold 130, at least in some regions. An optional polarity change of the applied voltage between the electrodes 110_1, 110_2 reverses accordingly also the direction of the electric field as well as the current direction.

The electrodes 110_1, 110_2 can, for example, be passed through holes in the wall 130_1, the feedthroughs being electrically insulated from the casting mold (wall 130_1).

FIG. 1 further shows an arrangement comprising a power supply 180 and the actuator 100. In operation, the power supply 180 is electrically connected to the electrodes 110_1, 110_2 of the actuator 100. The power supply 180 generates the waveform (pulses) and provides power to the signal (e.g., current pulses or voltage pulses). The power supply 180 may be current controlled (i.e., a current source) or voltage controlled (i.e., a voltage source). In the first case, current pulses of a predeterminable level are generated; in the second case, a predetermined voltage value is specified as the target value for the pulse level. Since in the first variant (current-controlled power supply 180) the contacting resistances between the electrodes 110_1, 110_2 and the metal melt 120 do not change the power introduced into the metal melt 120, the first variant may be considered.

The actuator 100 may further optionally include a magnetic field coil 150. The magnetic field coil 150 may generate a magnetic field in the direction of the magnetic field lines 152 shown as an example in FIG. 1. The magnetic field lines 152 may be oriented substantially perpendicular to the wall 130_1 in the region near the wall. The arrangement shown in FIG. 1, in which the magnetic field coil 150 is arranged between the electrodes 110_1, 110_2, ensures that the electric field and the magnetic field are superimposed and the field lines 112, 152 intersect.

A magnetic field of the type shown in FIG. 1 can be generated, for example, by a solenoid.

Figure 2:
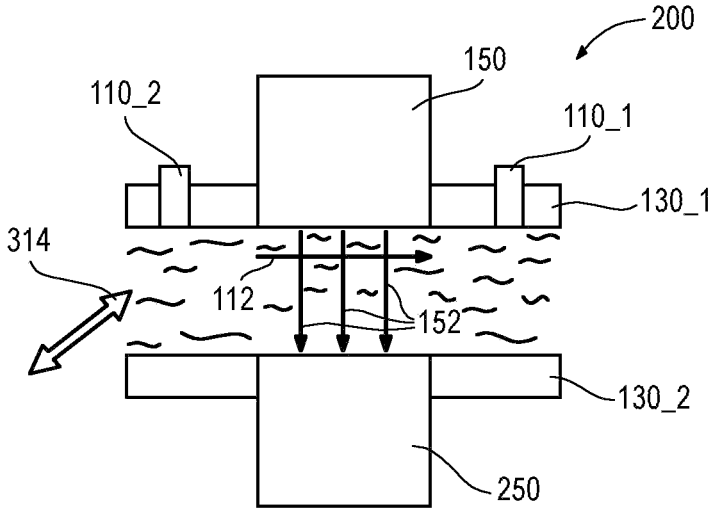
FIG. 2 shows another example of an actuator with two magnetic field coils.

FIG. 2 shows a cross-sectional view of a further example of an actuator 200. The actuator 200 differs from the actuator 100 essentially in that, in addition to the (optional) magnetic field coil 150 on wall 130_1, a further magnetic field coil 250 is arranged on a wall 130_2 of the casting mold 130 opposite wall 130_1. In this way, the magnetic field power coupled into the metal melt 120 can be amplified and it can be achieved that, for example, the entire wall thickness of the component is penetrated by a strong magnetic field.

Figure 3:
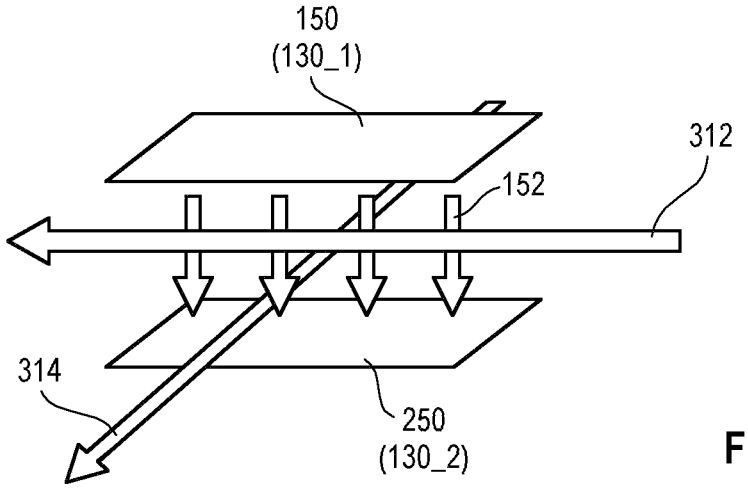
FIG. 3 illustrates the directions of the electric field, the magnetic field and a movement of the metal melt.

FIG. 3 illustrates the direction of the current flow 312 (which corresponds to the direction of the principal component of the electric field 112) and, if present, the direction of the magnetic field, which is illustrated by the magnetic field lines 152. Furthermore, FIG. 3 also shows the direction 314 of a magnetohydrodynamic flow of the metal melt 120, which can be obtained by superimposing the electric field on the magnetic field. In FIGS. 1 and 2, the direction 314 of the flow points out of the plane of the paper (or into the plane of the paper when the electric field is reversed, see the double arrow in FIG. 2).

Figure 4:
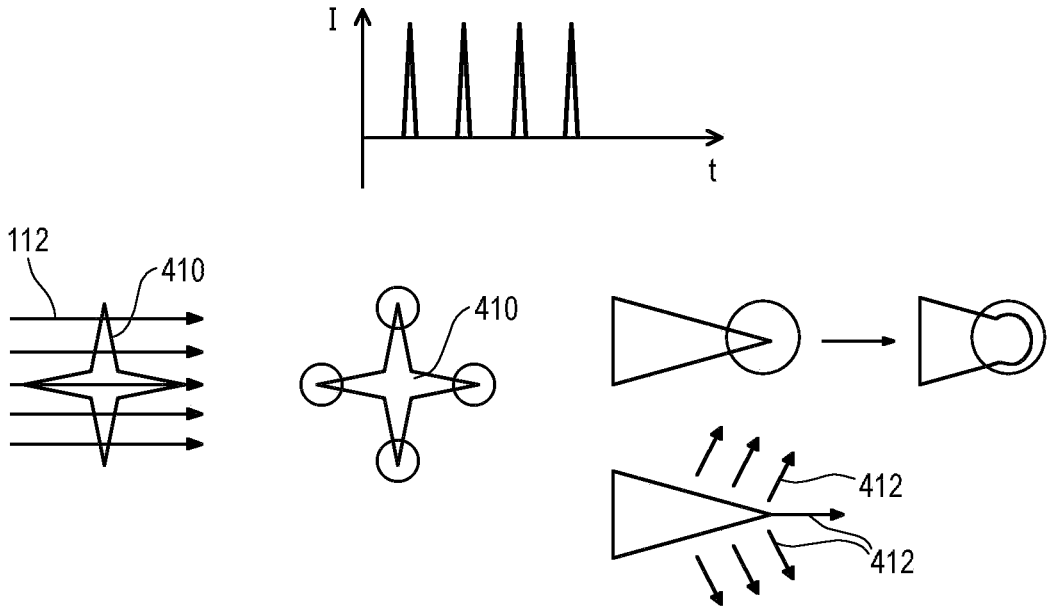
FIG. 4 illustrates the effect of a pulsing electric field on a dendrite of the metal melt.

FIG. 4 illustrates by several schematic diagrams the principle of grain refinement by applying a pulsing electric field to the metal melt 120. The current pulses (I) generated by the pulsing electric field are shown in the upper area of FIG. 4 versus time t. In the lower left region of FIG. 4, a dendrite 410 is shown schematically exposed to the electric field (field lines 112) in the metal melt 120. At the tips of the dendrite 410, high electric field strengths (see the field lines 412) are generated due to the potential difference that arises as a result of the different electric conductivity in the dendrite crystal (higher conductivity) and the metal melt 120 (lower conductivity). This results in locally excessive current flow in dendrite 410 and joule heating at the tips of dendrite 410 during a current pulse. The heating causes the tips to melt, which causes the tips to round (see FIG. 4, right portion, circled tip). The rounding of the tips reduces the surface area of the dendrite 410 and thus may reduce its heat exchange (cooling) with the metal melt 120. This impedes or delays further dendritic growth. The metal melt 120 solidifies in a fine-grained, rather globular structure with increased mechanical properties compared to the dendritic basic structure.

The lateral range in which this effect occurs can, for example, be equal to or smaller than 150 mm, 100 mm or 50 mm. This means that localized areas of the component can be particularly well influenced by exposure to a high electric field.

For example, the pulse frequency can be between 1 and 2000 Hz, for example between 100 and 1000 Hz. The higher the pulse frequency, the higher energy inputs are possible into the metal melt 120. In practice, it has been found that a power of, for example, 1 to 2 kW per actuator 100, 200 may be sufficient. Higher powers can also be coupled in, but require more expensive power electronics, especially at higher desired pulse frequencies.

Different signal shapes can be used for the pulses:

Triangular pulses (Dirac pulses) are the ideal signal shape for achieving the desired effect. However, problems may be caused by the electromagnetic compatibility or shielding of the system, since the external power supply acts as a broadband interferer.

Pulse width modulation (PWM) enables the generation of a pulsed direct current whose percentage of pulse duration and pause determines the power. For PWM signals, the frequency refers to the on/off period duration. For example, the PWM duty cycle can range from 5% to 95%. PWM signals are easy to generate and control. They were used in the experiments carried out.

Artificial pulse shapes, in which a current curve of choice is run, are also possible and allow optimization of the pulse shape in the direction of the Dirac pulse without its disturbing effect.

All waveforms can be operated with reversing pulses, i.e. the current direction can be changed after each pulse (or pulse train of a certain length), for example.

All signal shapes can be provided, for example, as a current signal or as a voltage signal. For example, the power supply 180 (see FIG. 1) can be a low-voltage power supply in combination with a frequency generator for switching the power supply 180 on/off.

Figure 5:
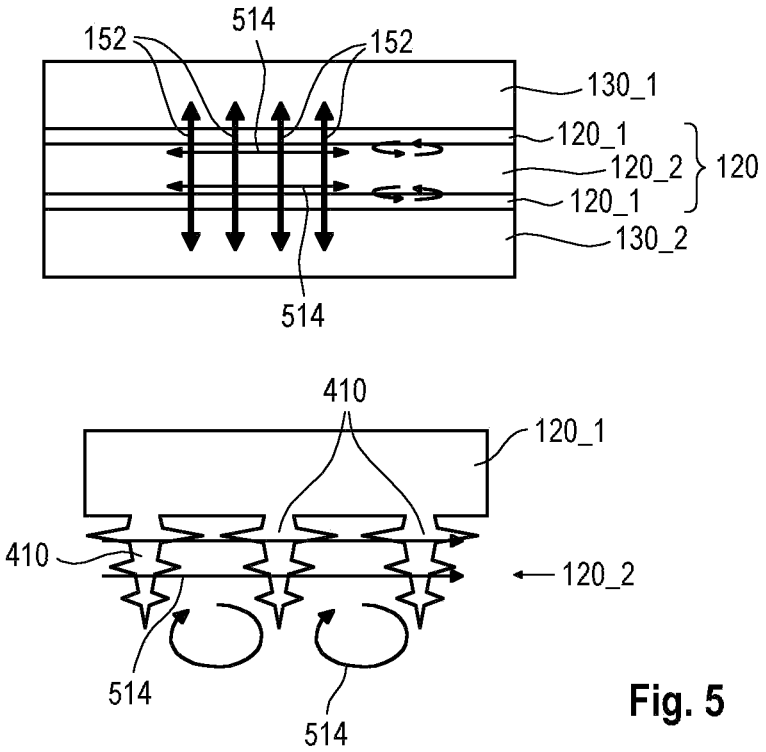
FIG. 5 illustrates the effect of a magnetic field on dendrites in the metal melt.

FIG. 5 illustrates the effect of an alternating magnetic field on grain growth. The two walls 130_1 and 130_2 of a casting mold and the metal melt 120 between the walls are shown.

During the process of solidification of the metal melt 120, an already solidified shell 120_1 is formed on the walls 130_1, 130_2, while the metal melt 120 is still liquid in the inner region 120_2. Due to a magnetic field (magnetic field lines 152), a flow 514 forms in the metal melt 120 and in particular at the interface between the solidified shell 120_1 and the still molten interior 120_2, which slows down the dendritic growth.

As illustrated in the lower portion of FIG. 5, the flow 514 can be linear or circular in the manner of a stirring motion. The flow 514 deforms or breaks off the dendrites 410 growing at the interface between the shell 120_1 and the interior 120_2 of the metal melt 120. This provides more time for endogenous grain growth, creating a fine-grained, less dendritic microstructure during the solidification process.

For example, the alternating magnetic field may be in the frequency range between 5 and 20000 Hz or 25000 Hz. Suitable design of the surrounding areas of the magnetic field coil 150, 250 can reduce inductive heating, which can limit the maximum achievable frequency (and thus the maximum achievable energy input into the metal melt 120). This undesirable heating can be counteracted, for example, by cooling the magnetic field coil 150, 250 and/or by using non-ferritic steels as casting mold material, for example also in the form of an insert in the casting mold wall in the vicinity of the magnetic field coil 150, 250. For example, austenitic steels or stainless steels (for example with austenite-stabilizing elements such as Cr and/or Ni) can be used as non-ferritic steels.

A power input of the magnetic field between 10 W and 10 kW may be sufficient for many applications.

By superimposing an alternating magnetic field on the pulsing electric field, an electromagnetic field can be induced which causes a circular magnetohydrodynamic movement of the metal melt 120 (magnetic stirring). The electromagnetic field induces an electric current in the metal melt, which generates an opposing electromagnetic field. This generates a force that moves the metal melt 120 in the manner of a small amplitude stirring motion. The magnetohydrodynamic action on the metal melt 120 can lead to reduced porosity in the cast component, which can be advantageous for the mechanical characteristics as well as for subsequent heat treatment of the cast component.

Movement of the metal melt can also be achieved by applying a static magnetic field and injecting a high pulse current (generated by the pulsing electric field) through the metal melt 120 when the direction of the electric current is reversed and/or the direction of the magnetic field in the magnetic field coil 150, 250 is reversed. Thus, the direction of flow in the metal melt is alternately reversed. That is, also in this way, it is possible to obtain an oscillating flow in the metal melt 120 with a low amplitude (for example, between 100 μm and a few mm), which is sufficiently large to reduce the concentration differences of the alloying elements between the liquid phase and the solidification zone at the interface of the growing crystals (i.e., between the shell 120_1 and the interior 120_2 of the metal melt 120). In this process, the metal melt oscillates with a small amplitude and the growing crystals cannot follow the motion directly due to their inertia. This relative motion causes the mixing. The mixing leads to a concentration and heat equalization at the solidification front.

In other words, the variation of the magnetic field and/or current may induce an eddy current near the interface of the growing crystals (dendrites), thereby producing a movement of the metal melt 120. This movement of the metal melt may be in the range of ultrasonic vibrations, but ultrasonic vibrations as such would have limited (acoustic) penetration depth into the interior 120_2 of the metal melt 120.

Figure 6:
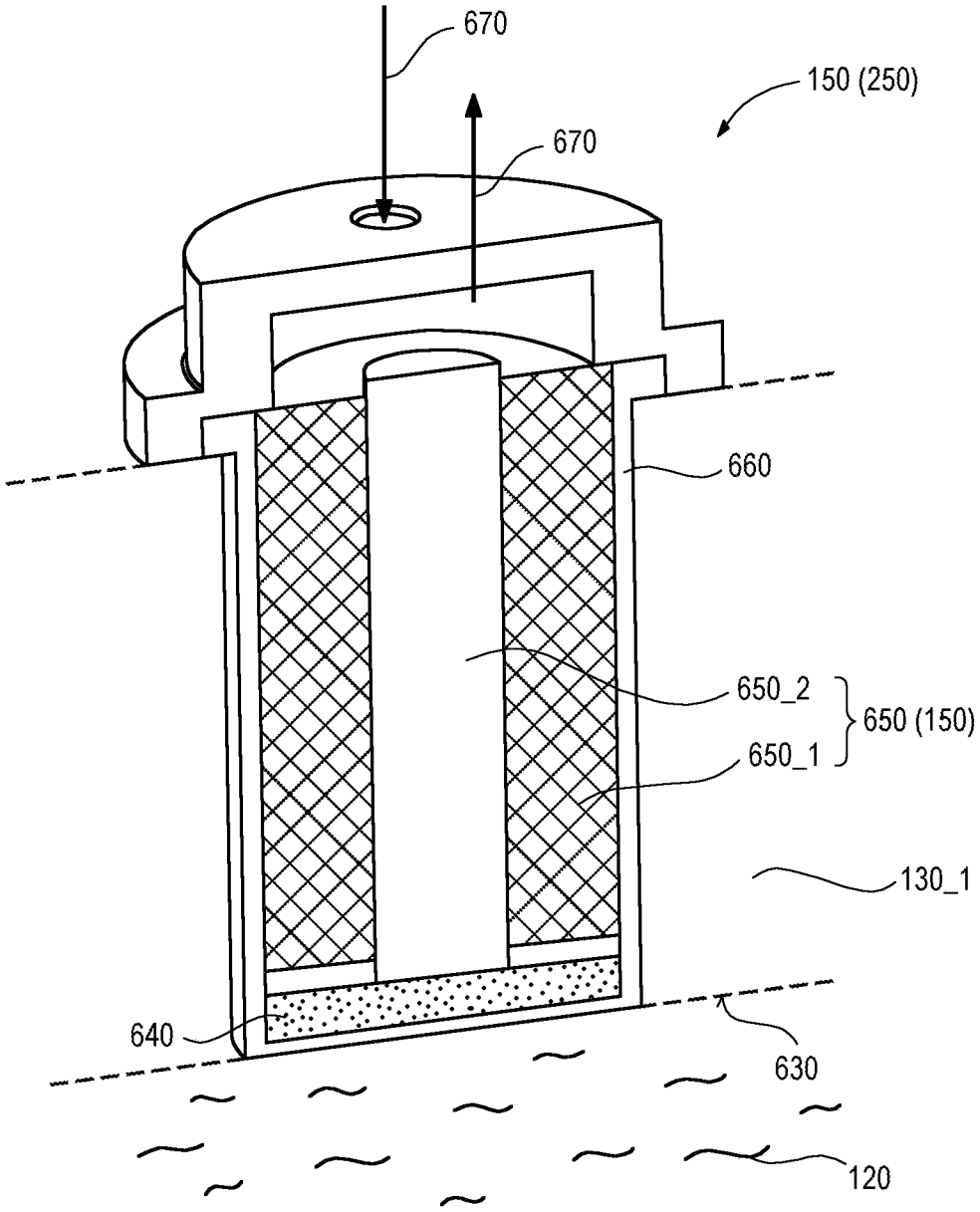
FIG. 6 shows a perspective sectional view of an example of an actuator with a magnetic field coil accommodated in a housing.

According to FIG. 6, the magnetic field coil 150 (250) can be in the form of a solenoid 650. The solenoid 650 may have a cylindrical winding 650_1 and a central core 650_2. The solenoid 650 is located, for example, in a housing 660. The housing 660 may be provided for installation in a wall recess of the casting mold (shown, for example, is the wall 130_1). The wall recess may be, for example, a through recess as shown in FIG. 6, or it may be formed by a recess in the casting mold (for example, in the wall 130_1) adjacent to the cavity.

The housing 660 may be cylindrical, for example, and thus easily insertable into a wall bore (through hole or blind hole). The diameter of the housing 660 may be, for example, equal to or less than or greater than 20 mm, 30 mm, or 50 mm. The length of the housing 660 may be, for example, between 80 mm or 100 mm and 200 mm.

The core 650_2 guides the magnetic field to a cavity surface 630. A non-ferritic plate 640 may be provided between the core 650_2 and the metal melt 120 to achieve the highest possible magnetic coupling between the magnetic field coil 150 (250), for example in the form of the solenoid 650, and the metal melt 120.

The magnetic field coil 150 (250) may be cooled by a coolant 670 that flows through the housing 660, for example. For example, oil, water, or air may be used as a coolant.

In a non-illustrated manner, it is also possible to cool the wall 130_1 of the casting mold in the vicinity of the recess for the housing 660. For example, the magnetic field coil 150 (250) may also be present in a non-ferritic insert in the wall 130_1, which may be provided with a coolant cooling system.

Figure 7:
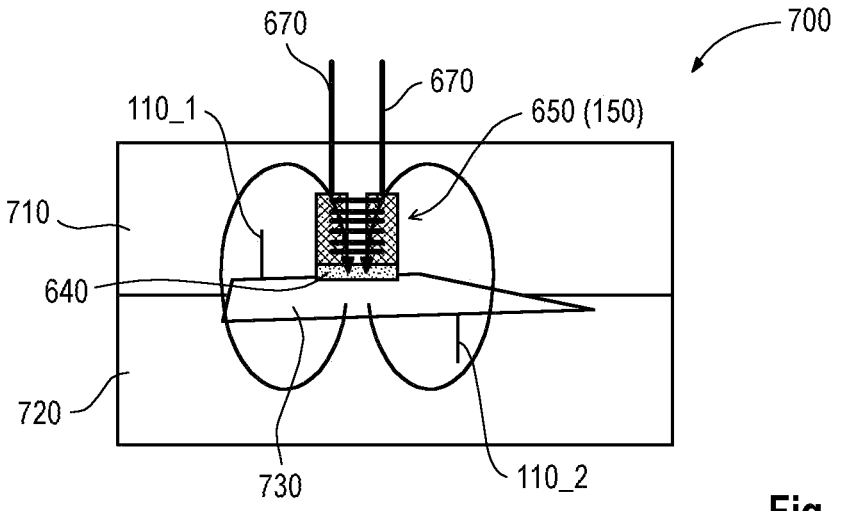
FIG. 7 shows an example of an apparatus for the production of a metal component with an actuator inserted into the casting mold.

FIG. 7 shows a schematic sectional view of an apparatus 700 for producing a metal component in a casting mold. In the example shown here, the casting mold comprises two casting mold halves 710, 720. The casting mold halves 710, 720 can form the walls 130_1 and 130_2 shown in the previous figures. Between the casting mold halves 710, 720 there is a cavity 730 in which the component to be produced is cast.

The casting mold 710, 720 may be, for example, a high pressure die casting mold, a low pressure die casting mold, or a gravity die casting mold.

In the example shown in FIG. 7, the first electrode 110_1 of the actuator is formed in the first mold half 710, while the second electrode 110_2 is formed in the second mold half 720, for example. Of course, it is also possible that the electrodes 110_1, 110_2 are realized either both in the first mold half 710 or both in the second mold half 720.

Furthermore, in the manner already described, the actuator may be equipped with a magnetic field coil 150, e.g. solenoid 650, which in the example shown here is present in the first mold half 710.

The magnetic field coil 150 inserted into the casting mold 710, 720 can, for example, be a fixed or integral part of the casting mold 710, 720, as illustrated in FIG. 7, or may be modularly attachable to and detachable from the casting mold 710, 720. In the area of the magnetic field coil 150 (e.g. solenoid 650), the surface 630 of the cavity 730 can be formed by an austenitic steel plate (corresponding to the non-ferritic plate 640), for example. The casting mold halves 710, 720 may be made of ferritic steel. Previously described features and functions of the actuators 100, 200 also relate to the apparatus 700 for producing a metal component.

Figure 8:
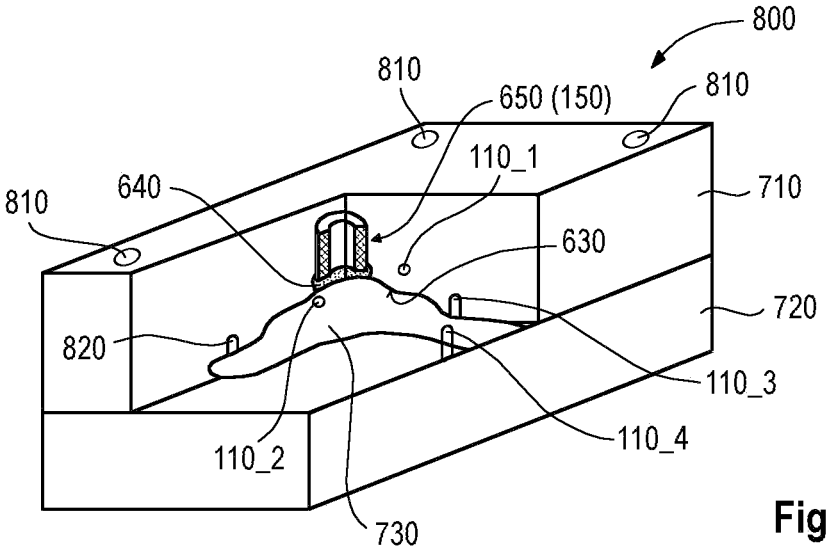
FIG. 8 shows a partial sectional perspective view of an example of an apparatus producing a metal component with an actuator inserted into the casting mold.

FIG. 8 shows an apparatus 800 for producing a metal component in a casting mold 710, 720. The apparatus 800 corresponds essentially to the apparatus 700, so reference is made to the above description in order to avoid reiteration. Also shown in FIG. 8 are casting mold guides 810 for opening and closing the casting mold halves 710, 720 and a gate 820 through which the metal melt can be introduced into the cavity 730.

The apparatus 800 comprises, for example, two actuators. One actuator comprises electrodes 110_1 and 110_2 and magnetic field coil 150, while the other actuator is implemented by electrodes 110_3, 110_4 alone, for example.

Figure 9:
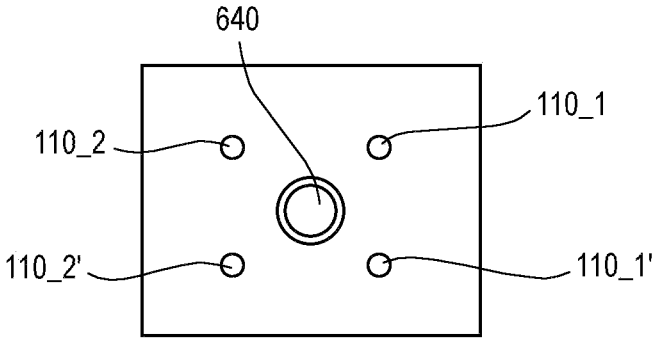
FIG. 9 shows an example of an arrangement of electrodes and a magnetic field coil as viewed from the cavity wall.

Referring to FIG. 9, the surface 630 of the casting mold cavity 730 may include a plurality of electrodes 110_1, 110_2, 110_1', 110_2' surrounding the magnetic field coil 150 (disposed behind the non-ferritic plate 640) and arranged, for example, symmetrically about the magnetic field coil 150. Due to the arrangement of the electrodes 110_1, 110_2, 110_1', 110_2' polygonally around the magnetic field coil 150 shown in FIG. 9, the mechanical properties of, for example, a round-shaped local component thickening opposite the magnetic field coil 150 (solenoid 650) can be particularly well influenced. The lateral dimensions of the electrode arrangement are scalable and can in particular be small (e.g. equal to or smaller than 150 mm, 100 mm or 50 mm). Only minor remodeling of the casting mold is required, which is why the grain refinement concept described here can be implemented very easily and variably. The various electrodes are used to change the direction of the electric field.

Figure 10:
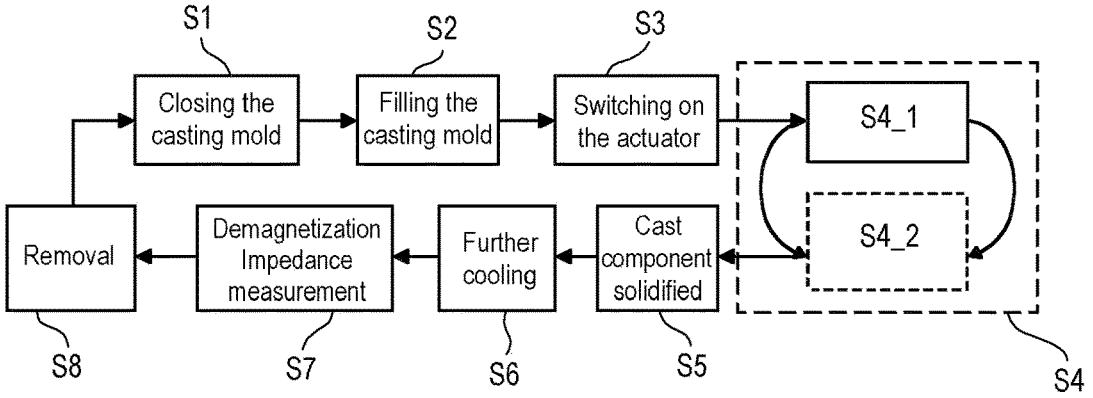
FIG. 10 shows a flow chart in which exemplary processes or stages of a method of producing a metal component are illustrated.

Referring to FIG. 10, an example of a method for producing a metal component may include the following stages or processes.

At S1, the casting mold is closed. It can be, for example, a high-pressure die casting mold, low-pressure die casting mold or gravity die casting mold.

At S2, the casting mold is filled with a metal melt. All mentioned types of filling and materials of metal melt can be used.

At S3, the actuator is switched on. The impact phase S4 comprises the coupling of the pulsing electric field at S4_1 and the optional simultaneous magnetohydrodynamic mixing of the metal melt at S4_2.

The impact phase S4 is completed and at S5 the metal melt has solidified, i.e. the cast component is in the solid phase.

At S6, further rapid cooling can optionally be carried out to improve the mechanical properties of the cast component. This further cooling is carried out in addition to the natural cooling by heat extraction by means of a cooling apparatus.

At S7, optional demagnetization and impedance measurement is performed for quality monitoring purposes.

At S8, the finished cast component is removed from the casting mold. The production cycle can then start again at S1.

Figure 11:
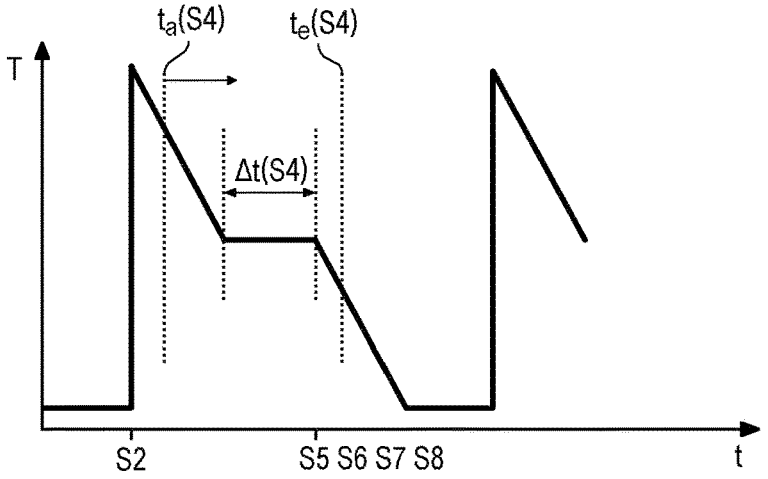
FIG. 11 shows a diagram in which the effect on a metal melt by an actuator is shown as a function of temperature and time.

FIG. 11 illustrates the chronological sequence of the individual process stages in an exemplary manner. The temperature T of the cast component is shown schematically on the Y axis and the time t on the X axis.

When the casting mold is filled with the hot metal melt at S2, the temperature in the casting mold rises abruptly to a maximum value. This is followed by the cooling and solidification process. At $t_a$(S4), the actuator is switched on and electrical or electromagnetic impact on the metal melt begins. At $t_e$(S4), the actuator is switched off and the impact process ends.

During an intermediate period Δt(S4), the phase transition of the metal melt from the liquid phase to the solid phase takes place. Over this period, the impact process has a grain-refining effect in the manner described.

The further stages S6, S7 take place during cooling of the cast component in the solid phase. At S8, the cast component is removed and the next production cycle can begin.

Figure 12:
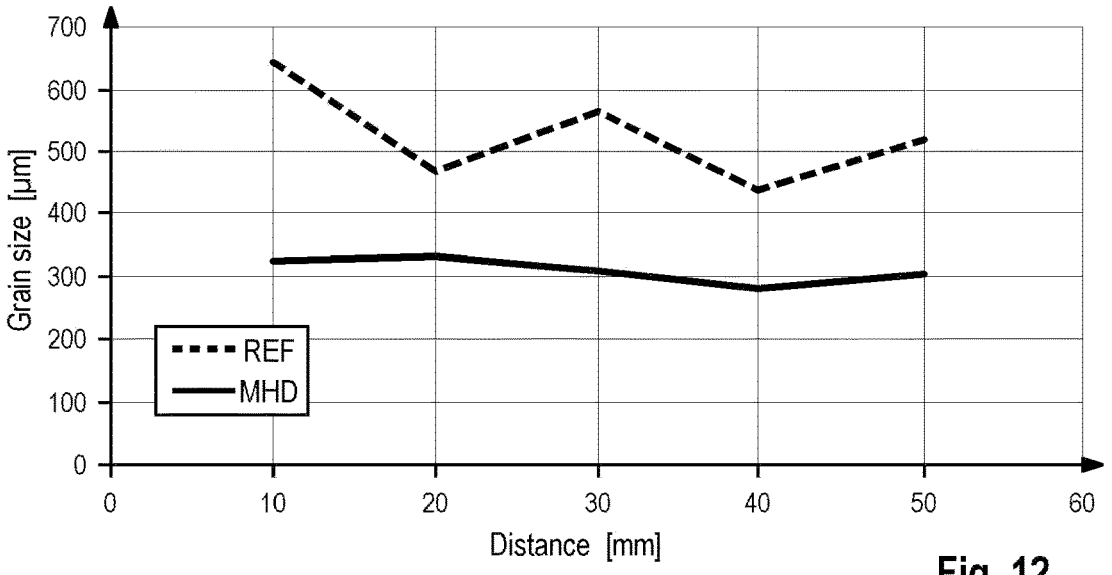
FIG. 12 shows a diagram in which measured grain sizes in the cast component are shown as a function of the distance from the center of the actuator when the actuator is activated and, as a reference, without its activation.

FIG. 12 illustrates the grain refining effect of a magnetohydrodynamic action on the metal melt with an actuator which generates both a pulsing electric field (i.e. a pulsing current flow) and an alternating magnetic field superimposed on it. Shown is the average grain size of a cast component sample determined in tests as a function of the distance from the actuator (measured along the solenoid axis).

The experimental data refer to a gravity casting of a metal melt made of AlSi7Mg0.3. The starting temperature of the metal melt was 720° C., and the starting temperature of the casting mold was 220° C. A pulsing current of 100 A, generated by a current-controlled current source, with 20% duty cycle PWM, with a pulse frequency of 50 Hz was used. The power coupled through the magnetic field coil was only 14 W. A single actuator 100 as shown in FIG. 1 (with a magnetic field coil) was used on one of the casting mold walls.

A reduction in grain size of around 40% was achieved essentially over the entire component thickness. This corresponds to an increase in the number of grains by a factor of eight, resulting in a significant improvement in the mechanical properties of the cast component in the area of electromechanical impact and magnetohydrodynamic movement of the metal melt, respectively.

Figure 13:
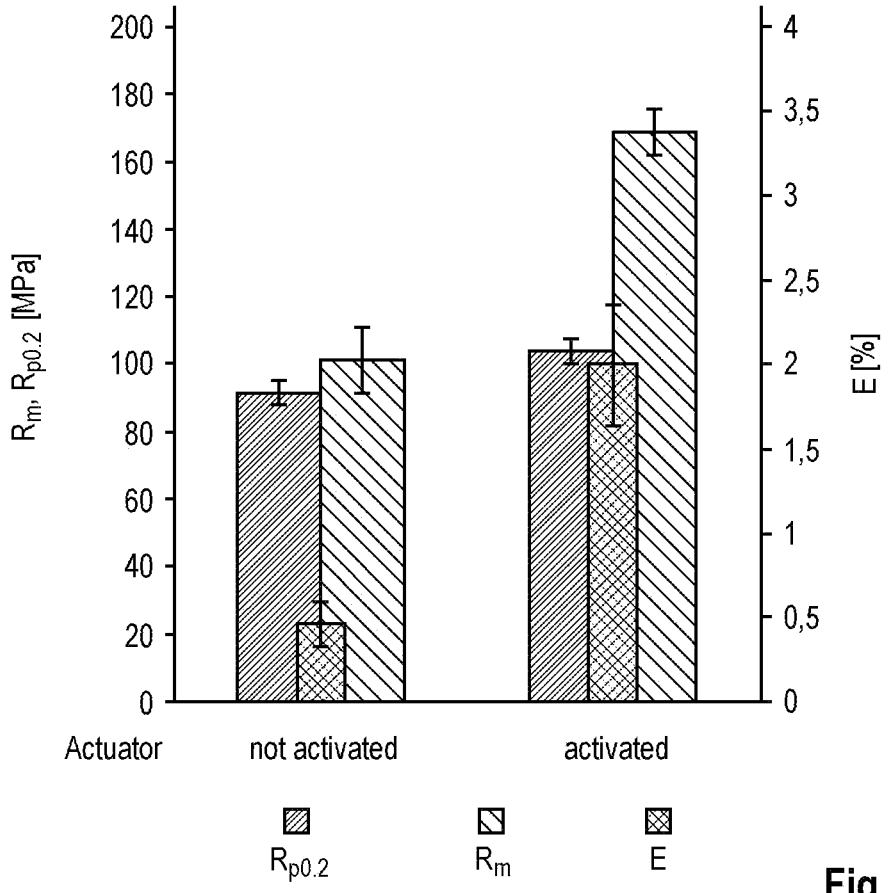
FIG. 13 shows a diagram in which mechanical parameters from tensile tests on a cast component with and without activated actuator are given.

FIG. 13 shows the mechanical properties of the cast component determined from tensile tests. The tensile test was carried out according to DIN EN ISO 6892-1 with tensile specimens according to DIN 50125. The cast component was manufactured as described above, except that the frequency was increased to 2000 Hz in this test. The wall thickness of the cast component was 6 mm. Compared with a reference component without activated actuator, an improvement of 333% in elongation at break E (elongation), 66% in tensile strength $R_m$ [MPa] and 13% in the 0.2% elongation limit $R_{p0.2}$ [MPa] was achieved.

The following Table 1 summarizes the measured mechanical properties of cast components produced with the respective excitation parameters given in the table. Here, (x W/y %) denotes the coupling of a magnetic power of x watts into the melt during the solidification process and the coupling of a PWM pulse current with a PWM duty cycle of y % into the melt during the solidification process. The PWM pulse current was regulated to 100 A, with a voltage of about 1V, i.e., with a PWM duty cycle of, say, 30-80%, about 30-80 W of electrical power is coupled into the melt. The magnetic stirring power was in the range of 10-500 W.

TABLE 1

(Mechanical properties)

| | Reference-values | 10-500W/30-80% | 10-500W/0% | 0W/30-80% |
|---|---|---|---|---|
| YS | 89 MPa (+−2) | 94.4 MPa (+−2.7) (ref.: +6%) | 88.9 MPa (+−1.9) (ref.: +0%) | 91.4 MPa (+−3.8) (ref.: +3%) |
| UTS | 160 MPa (+−6) | 178.3 MPa (+−4.8) (ref.: +11.5%) | 176.7 MPa (+−2.2) (ref.: +10%) | 174.3 MPa (+−3.1) (ref.: +9%) |
| E | 2.48% (+−0.5) | 3.3% (+−0.5) (ref.: +33%) | 3.73% (+−0.3) (ref.: +50%) | 3.55% (+−0.5) (ref.: +43%) |

In Table 1, YS (0.2% Offset Yield Strength) indicates the 0.2% yield strength $R_{p0.2}$, UTS (Ultimate Tensile Strength) indicates the tensile strength $R_m$, and E (Elongation) indicates the elongation at break.

The porosity in the reference cast component (actuator not activated) was 0.8284% with D5=39 μm, D50=141 μm, D95=809 μm and Dmax=1979 μm. In the cast component with electrical and magnetic excitation, the porosity was 0.1001% with D5=11 μm, D50=22 μm, D95=86 μm and Dmax=135 μm. D50 means that 50% of the particles are smaller than the specified value. The electrical and magnetic excitation significantly reduced the porosity, and also greatly reduced the size of the pores (large pores can act as crack initiators), especially of the largest pores (Dmax), which is mainly reflected in increased elongation at break.

It is apparent that the mechanical properties are improved by electrical and magnetic excitation of the melt. Magnetic stirring leads to a significant increase in UTS and E. Electrical pulsing slightly increases YS and leads to a more significant increase in UTS and E. The combination of both excitations leads overall to the best results in terms of the desired mechanical properties.

Figure 14:
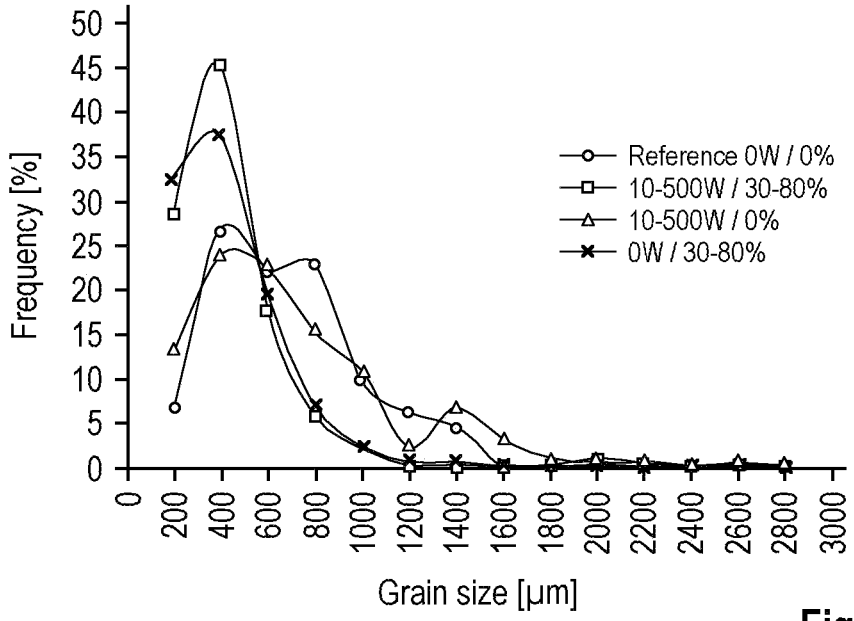
FIG. 14 shows measured grain size distributions of cast components produced with magnetic excitation only, with electrical excitation only, or with both magnetic and electrical excitation.

FIG. 14 shows the measured grain size distribution of cast components produced without electrical and magnetic excitation (reference), with magnetic excitation only in the range of 1-500 W, with electrical excitation only in the range of 30-80% PWM duty cycle or with both magnetic and electrical excitation as described above (i.e. with the same values as in the above curves in each case).

It is shown that with magnetic stirring alone, a somewhat more homogeneous particle size distribution can be achieved compared to the reference distribution without electrical and magnetic excitation, but it does not show an increase in the frequency of small particle sizes.

Electrical pulsing significantly increases both the homogeneity of the distribution and the frequency of small grain sizes. The average grain size is reduced by 10% to 20%. The grain size was determined according to the specification in Espinal, Laura. "Porosity and its measurement", Characterization of Materials (2002): 1-10.

Remarkably, a combination of magnetic stirring and electrical pulsing not only further improves the homogeneity of the distribution, but also again significantly increases the frequency of small grain sizes. The average particle size is reduced by more than 30% (measured: 32% reduction). The %-figures (percentage values) refer to the reference without electrical and magnetic excitation. I.e., in terms of grain size reduction (or the frequency of small grain sizes), the combination of magnetic stirring and electrical pulsing produces a synergistic effect that significantly exceeds the addition of the individual effects of the two excitation methods.

In summary, these and other tests conducted show that electrical pulsing significantly reduces the size of the grains and therefore leads to an increase in the strength of the cast component. Magnetic stirring alone does little to improve strength, but it does increase casting quality by reducing porosity and improving homogeneity of the metal structure. A combination of both measures can produce high-strength cast components with very good casting quality.

The invention claimed is:

1. An actuator for a casting mold for producing a metal component, the actuator comprising:

a magnetic field coil including a cylindrical winding, the magnetic field coil a wall of the casting mold that has a wall recess;

at least two electrodes at the wall so that the magnetic field coil is between at least a pair of electrodes of the at least two electrodes; and a housing accommodating the magnetic field coil, the housing installable in the wall recess, wherein with the housing installed in the wall recess, a metal melt present in the casting mold, and the actuator operated, the pair of electrodes are in contact with the metal melt, and are configured to generate a local pulsing electric field in the metal melt and to introduce a pulsing current into the metal melt, the magnetic field coil is configured to generate a local magnetic field in the metal melt, the magnetic field coil and the pair of electrodes are configured so that a direction that the cylindrical winding extends is substantially perpendicular to the local pulsing electric field, and the local pulsing electric field has a main component which extends substantially parallel to the wall.

2. The actuator of claim 1, further comprising:

a coolant cooling duct accommodated in the housing.

3. The actuator of claim 1, wherein the magnetic field coil includes a solenoid having the cylindrical winding and a central core.

4. The actuator of claim 3, further comprising a non-ferritic plate provided between the central core and the metal melt.

5. The actuator of claim 1, wherein the main component of the local pulsing electric field is superimposed with magnetic field lines in a region near the wall, and in the region near the wall, the magnetic field lines are oriented substantially perpendicular to the wall.

6. An apparatus for producing a metal component, comprising:

a casting mold having a wall with a wall recess and a cavity, the casting mold configured to cast mold the metal component from a metal melt; and an actuator for the casting mold, the actuator including:

a magnetic field coil including a cylindrical winding, the magnetic field coil at the wall, at least two electrodes at the wall so that the magnetic field coil is between at least a pair of electrodes of the at least two electrodes, and a housing accommodating the magnetic field coil, the housing installable in the wall recess, wherein with the housing installed in the wall recess, the metal melt present in the casting mold, and the actuator operated, the pair of electrodes are in contact with the metal melt, and are configured to generate a local pulsing electric field in the metal melt and to introduce a pulsing current into the metal melt, the magnetic field coil is configured to generate a local magnetic field in the metal melt, the magnetic field coil and the pair of electrodes are configured so that a direction that the cylindrical winding extends is substantially perpendicular to the local pulsing electric field, and the local pulsing electric field has a main component which extends substantially parallel to the wall.

7. The apparatus of claim 6, wherein the pair of electrodes of the actuator are arranged on both sides of the wall recess.

8. The apparatus of claim 6, wherein the casting mold is a high pressure die casting mold, a low pressure die casting mold, or a gravity die casting mold.

9. A method of producing a metal component, comprising:

filling a casting mold with a metal melt, the casting mold having a wall with a wall recess and a cavity configured to cast mold the metal component;

generating a local pulsing electric field in the metal melt by at least two electrodes in contact with the metal melt to introduce a pulsing current into the metal melt; and generating a local magnetic field in the metal melt by a magnetic field coil including a cylindrical winding, wherein the magnetic field coil is at the wall and between at least a pair of electrodes of the at least two electrodes, the wall recess is configured to receive a housing accommodating the magnetic field coil, the magnetic field coil and the pair of electrodes are configured so that a direction that the cylindrical winding extends is substantially perpendicular to the local pulsing electric field, the pair of electrodes are arranged at a same wall of the casting mold with the wall recess, and the local pulsing electric field has a main component which extends substantially parallel to the wall.

10. The method of claim 9, wherein a power of 30 W to 5 kW is coupled into the metal melt by the local pulsing electric field, and/or the local pulsing electric field has a pulse frequency between 1 and 2500 Hz.

11. The method of claim 10, wherein as a result of the local pulsing electric field a pulsed current between 2 and 1000 A flows through the metal melt.

12. The method of claim 10, wherein the local pulsing electric field and the local magnetic field are superimposed.

13. The method of claim 9, wherein as a result of the local pulsing electric field a pulsed current between 2 and 1000 A flows through the metal melt.

14. The method of claim 13, wherein the local pulsing electric field and the local magnetic field are superimposed.

15. The method of claim 9, wherein the local pulsing electric field and the local magnetic field are superimposed.

16. The method of claim 15, wherein a power of 10 W to 10 kW is coupled into the metal melt by the local magnetic field, and/or wherein the local magnetic field has an alternating current frequency between 5 and 25000 Hz.

17. The method of claim 6, wherein the casting mold is a high pressure die casting mold, a low pressure die casting mold, or a gravity die casting mold.

* * * * *